US008590252B2

(12) United States Patent
Cordeiro

(10) Patent No.: US 8,590,252 B2
(45) Date of Patent: Nov. 26, 2013

(54) GROUTLESS TILE SYSTEM

(71) Applicant: Eurico Januario Cordeiro, East Providence, RI (US)

(72) Inventor: Eurico Januario Cordeiro, East Providence, RI (US)

( * ) Notice: Subject to any disclaimer, the term of this patent is extended or adjusted under 35 U.S.C. 154(b) by 0 days.

(21) Appl. No.: 13/848,332

(22) Filed: Mar. 21, 2013

(65) Prior Publication Data

US 2013/0212971 A1 Aug. 22, 2013

Related U.S. Application Data

(63) Continuation-in-part of application No. 13/209,457, filed on Aug. 15, 2011, now Pat. No. 8,438,813.

(51) Int. Cl.
*E04B 2/00* (2006.01)

(52) U.S. Cl.
USPC ..... 52/588.1

(58) Field of Classification Search
None
See application file for complete search history.

(56) References Cited

U.S. PATENT DOCUMENTS

| | | | |
|---|---|---|---|
| 6,769,835 | B2 | 8/2004 | Stridsman |
| 6,854,235 | B2 | 2/2005 | Martensson |
| 7,993,731 | B2 | 8/2011 | Miller et al. |
| 8,176,698 | B2 | 5/2012 | Lewark |
| 2005/0144875 | A1 | 7/2005 | Lenhard-Backhaus et al. |
| 2006/0080910 | A1 | 4/2006 | Cornia |
| 2006/0225370 | A1 | 10/2006 | Moriau et al. |
| 2008/0184646 | A1 | 8/2008 | Alford et al. |
| 2009/0031662 | A1 | 2/2009 | Chen et al. |
| 2010/0186337 | A1 | 7/2010 | Barretto |

FOREIGN PATENT DOCUMENTS

| | | |
|---|---|---|
| WO | WO2011/001326 | 1/2011 |

*Primary Examiner* — Mark Wendell
*Assistant Examiner* — Keith Minter
(74) *Attorney, Agent, or Firm* — Chace Ruttenberg & Freedman; LuAnn Cserr

(57) ABSTRACT

Floor, ceiling and wall covering (01) material, consisting of natural stones, i.e. marble, granite, limestone, onyx, travertine and sandstone, cement based tiles, softwood and hardwood, wood fiber HDF, MDF, agglomerated cork, rubber, and composite tile materials, such as stone, quartz or vinyl composition tiles, in format of tile slabs. Which the thickness is between 4 mm and 35 mm in which at the two opposite edges or sides are jointed together and interlocked by mechanical locking means, by connecting or inserting, (A6 to A5) and connecting or pressing downward (A8 to A9) using polyvinyl chloride (PVC) couplings, connecting in the form of a tongue and a groove which will prevent shifting of two interlocked tiles and or slabs into the opposed direction of each section tile or slab, with an integrated backing layer consisting of cork syntactic foam material, The invention relates to a natural stone core tile slab, allowing for an installation without the use of cement, adhesives or grout, provided with such a mechanical locking system jointed to the core (A4) according to the invention.

18 Claims, 4 Drawing Sheets

GROUTLESS TILE SYSTEM

CROSS-REFERENCE TO RELATED APPLICATIONS

This is a continuation-in-part of U.S. Ser. No. 13/209,457 filed Aug. 15, 2011.

FIELD OF THE INVENTION

The invention relates to a groutless tile system.

BACKGROUND OF THE INVENTION

Tile is good material for floor and walls covering, especially in bathrooms and kitchens where water is used. In bathrooms it is especially desirable on walls, floors and ceilings. Natural stone is an excellent product for flooring tile slabs because it is composed of a hard core as well as being water proof and 100 percent moisture resistant.

The most common difficulty when installing natural stone tile slabs, is to, accurately, install the tile slabs in such a way, that the corners of four tile slabs align without visible curves after installation in a certain order, therefore avoiding different widths between said tiles. Other disadvantages are the preparation of the subfloor which, needs to be free from indentations the necessary use of cement and adhesives, another disadvantage is the grout between tile slabs in which stains dirt and grime are impregnated and therefore difficult to maintain clean. Besides the disadvantages mentioned, the traditional installation process is time-consuming and, expensive requiring the use of specialized labor.

Unlike wood based products, the natural stone and porcelain floor tile slabs provide core stability and, as mentioned, is 100 percent moisture resistant.

Due to said advantages, the inventor recognized the need to integrate a mechanical locking system to facilitate the installation process without the need for cement, adhesives and grout. Over the years several flooring products, of other then natural stone, have incorporated mechanical locking systems. Therefore, the inventor recognized the potential of the natural stone core and invented a form of incorporating the mechanical locking system in a manner that is cost-effective and technically viable buy cutting horizontally into the stone core on all four sides of tile slabs and inserting pre-milled polyvinyl chloride couplings, thus obtaining a tight lock without excess movement on the locking connection.

Therefore, the inventor, by introducing the mechanical locking system, makes natural stone tile slabs more accessible to the flooring trade and to the home owner, without the use for cement, adhesives and grout. Another important characteristic is to the environment. Stone is an environment friendly flooring product with an adhesives free installation.

SUMMARY OF THE INVENTION

The inventor has been involved in the tile market for many years and has seen many changes over the years with new products coming into the market and traditional products becoming more popular. Stone is considered to be an excellent floor covering but not yet considered a floor covering that can be easily installed due to the need for cement, adhesives and grout. In U.S. Ser. No. 13/209,457, the inventor disclosed a mechanical locking system that could be used for natural stone floor tiles such as marble, granite, limestone, onyx, travertine and sandstone. The same system may also be employed for wall and ceiling tiles made of the same materials.

The inventor recognized that making a natural stone or other tile products more accessible to the tile trade with easier installation would be challenging, but its determination led to the invention. The advantages are overwhelming. The installation without cement, adhesives and grout is the installation method of the future for natural stone coverings. With the mechanical locking system mentioned allows the professional or the homeowner to accurately align all four corners of the tile slabs simply by clicking each tile slab into place, without out the use grout in between each tile slab. The sub floor, wall or ceiling preparation is also simplified due to the tile slabs integrated backing layer that will not only insulate said tile slabs but will allow the tile slabs to be installed even if the sub floor has some imperfections, according to the invention Natural stone and ceramic tiles and the like are environmentally friendly and where no adhesives are used during the installation process, they are even more environmentally friendly. An insulation backing layer made of cork or of a syntactic material that is incorporated to the underside of the tile slabs provides, for floor tiles, a comfortable underfoot feeling, as well as, having acoustical and thermal advantages when used for walls and ceilings.

In summary, incorporating into tile slabs the referred mechanical system and a backing layer, will give the tile covering trade a recognized covering that is water proof and can be installed by professionals and or homeowners alike. The mechanical system can be incorporated into cement based tiles, softwood and hardwood, wood fiber such as high density fiberboard (HDF), medium density fiberboard (MDF), engineered plywood, agglomerated cork, rubber, and composite tile materials, such as stone, quartz or vinyl composition tiles. Exemplary quartz tile composites are made by Rickett™ (Bergen, Norway). Vinyl composition tiles are marketed by numerous manufacturers and are well known in the art.

DETAILED DESCRIPTION OF THE INVENTION

Figure 1:
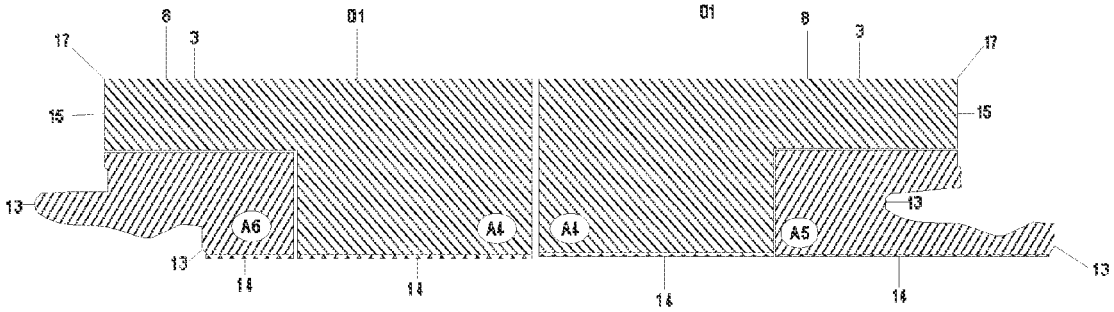
FIG. 1 is a schematic diagram showing a side view of one embodiment with couplings (A6, A5,) jointed to the natural stone core (A4) and tile slab (01), according to the invention.

The invention describes the manner in which natural stone tile slabs (01) consisting of a natural stone core (A4) can be illustrated without the use of cement, adhesives and grout. The invention will also show the coupling parts (A6, A5, A8, A9) that connect the tiles together by mechanical locking means and explain in more detail the manufacturing process. Further, a backing layer (14) that is jointed to the underside of the tile slabs, create a comfortable underfoot feeling as well as an environment friendly installation, according to FIGS. 1, 2, 3 and 4 and as describes hereafter, according to the invention.

The invention is intended for all natural stone core (A4) tile slab floors, walls and ceilings (01), but generally it can also be applied, such as to porcelain tile coverings. It is also known that all natural stone tile slabs and porcelain (01) coverings are applied using cement, adhesives and grout. The mechanical system also can be incorporated into cement based tiles, softwood and hardwood, wood Fiber HDF, MDF, engineered plywood, agglomerated cork, rubber, and composite tile materials, such as stone, quartz or vinyl composition tiles.

Common installation practices for natural stones tile slabs (01) have many disadvantages; floors, walls and ceilings are installed, using cement and adhesives to secure the tile slabs to the subfloor or wall and ceiling surface and the use of grout in between each tile slab holds the tiles in place. Another disadvantage is the installation time needed and the use of adhesives which may contain volatile organic compounds (VOCS).

The invention aims to improve the natural stone covering (01) installation method, without the use of cement, adhesives and grout and also shows the advantage that mistakes are not committed during installation.

The invention describes the manner in which natural stone tile slab (01) can be installed by mechanical locking means, without the use of cement, adhesives and grout. The couplings (A6, A5, A8, A9) are made from polyvinyl chloride, hereby noted that said couplings are not part of the natural stone core (A4), and not part of the covering surface (08) but only part of the mechanical locking system. Therefore connecting said tile slabs (01).

The polyvinyl chloride coupling parts (A6, A5, A8, A9), are realized and manufactured in one piece only and jointed to the natural stone core (A4) as one piece with dimensions of 3 mm to 38 mm in depth or thickness and 3 mm to 38 mm in width. Therefore it is hereby noted that said couplings (A6, A5, A8, A9) are only part of the mechanical locking system and not part of the surface area of said natural stone tile slabs (01). Said coupling parts (A6,A5,A8,A9), are provided with integrated mechanical locking means which prevent the drifting apart of two coupled tile slabs into a direction perpendicular to the related edges; these coupling parts (A6,A5,A8, A9), are connected in such a manner that they exclude excess movement therefore, improving the installation method.

The coupling parts (A6, A5, A8, A9), provide for a perfect connection between adjacent tile slabs that can be guaranteed, without shrinkage of the floor surface. Said coupling parts (A6, A5, A8, A9) are provided at the four sides, made of one single section of polyvinyl chloride, or either of another construction than described above or not, but not of the same core material (A4) of the tile slabs (01). The coupling parts can extend up to 19 mm beyond the tile edge.

The tile slabs (01) are connected at least at the edges of two opposite sides with coupling parts (A6, A5, A8, A9), which will allow for adjacent tile slabs (01) to connect to each other without drifting apart. Furthermore, all embodiments of couplings elements (A6, A5, A8, A9), can be applied on the long side as well as the short side. The mechanical locking couplings elements (A6, A5, A8, A9), are provided with inclined manner, according to a direction which simplifies the snapping-together effect.

In addition the invention refers to a resin type sealant (15) that is applied where the couplings joints (A6, A5, A8, A9) connect together as described in the manufacturing process for moisture protection as outlined (13), according to the drawings.

Furthermore the polyvinyl chloride couplings (A6, A5, A8, A9), material can be made either of recycled polyvinyl chloride (PVC), virgin PVC material, or a mixture of both.

The invention as described combines the mechanical locking system that is known to be patented by UNILIN BEHEER BV and FLOORING INDUSTRIES LIMITED, SARL and are hereby noted to facilitate the installation procedure of natural stone core (A4) tile slabs (01). With polyvinyl chloride couplings (A6, A5, A8, A9) not part of the natural stone core (A4), according to the invention.

The following illustrates the manufacturing process and the manner in which polyvinyl chloride couplings (A6,A5, A8,A9,) are inserted into the core (A4) of natural stone tile slabs (01) and manufactured or altered in an optimum manner. Cutting into the natural stone core material (A4) horizontally will create an opening of 3 mm to 38 mm in depth or thickness and 3 mm to 38 mm in width on the underside of the tile slab (01) and on all four sides or edges. After openings are completed the polyvinyl chloride couplings (A6, A5, A8, A9,) are inserted into said opening and jointed to the core (A4). A backing layer (14) which covers the entire underside of the tile slab is applied immediately and a predetermined amount of tile slabs are pressed together to insure the couplings, (A6, A5, A8, A9) and the backing layer (14) are jointed and pressed. After pressing, tile slabs (01) are ready to be profiled into the shape of the polyvinyl chloride couplings, (A6, A5, A8, A9) according to the FIGS. 1, 2, 3 and 4.

The manufacturing profiling equipment that will shape and profile the mechanical locking system couplings (A6, A5, A8, A9) is similar to the wood flooring industry but with alterations for cutting into the stone core (A4), according to the invention.

The inventor found that the aforementioned materials, in particular polyvinyl chloride, have ideal features in order to realize a connection, when jointed to the core (A4) which has the flexibility needed for milling, thus obtaining a perfect connection with polyvinyl chloride couplings (A6,A5,A8, A9).

Natural stone tile slabs (01) are provided with a decorative finish (8) as shown on drawing which can be honed, polished, sawn cut, antiquated, brushed, tumbled, bush hammered with a variety of natural stone patterns, even with a fancy pattern. The protective top layer (3) consists of a polyurethane layer of resin transparent material with a gloss or matt finish. Said tile slabs (01) can be of various shape, for example, rectangular or square, or of any other shapes.

An important characteristic of the invention is the backing layer (14) that is integrated onto the underside of the tile slabs core (A4) made of cork or of syntactic foam material therefore will insulate and provide acoustical and thermal properties and create a comfortable underfoot feeling for natural stone tile slabs (01).

Referring to FIG. 1 represents a tile slab (01) consisting of a natural stone core (A4) with mechanical locking system couplings namely (A6-A5) made of polyvinyl chloride. Such couplings have a thickness or depth of around 3 mm to 38 mm and around 3 mm to 38 mm of width or length jointed to the core (A4) of one tile slab (01). Further, shows the surface finish (08) that can have different finishes such as honed, polished or similar. Further, also shows a protective coating consisting of a polyurethane transparent layer (3). Further, also shows a resin sealant material (15) that is applied during the manufacturing process to protect the coupling joints (13). Further, also shows a micro bevelled edge (17) on all four sides of tile slab. Further in addition, it shows a backing layer (14) consisting of cork and a syntactic foam material that is acoustical and thermal and, when used on floors provides a comfortable underfoot feeling, according to the invention.

Figure 2:
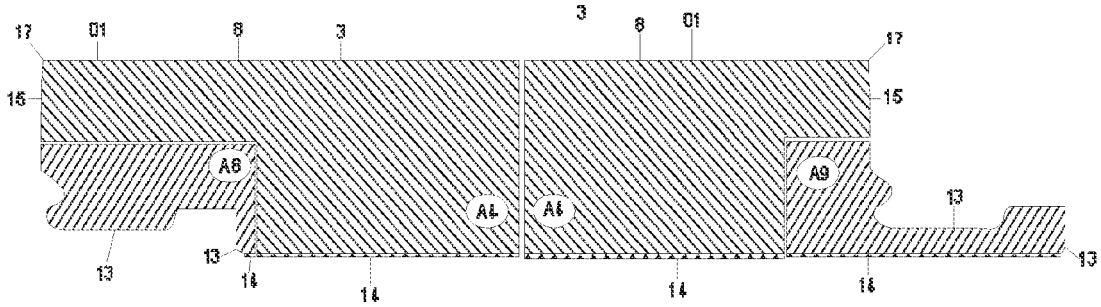
FIG. 2 is a schematic diagram showing a side view of another embodiment with couplings (A8, A9,) jointed to the natural stone core (A4) and tile slab (01), according to the invention.

Referring to FIG. 2 represents a tile slab (01) consisting of a natural stone core (A4) with mechanical locking system couplings namely (A8-A9) made of polyvinyl chloride, such couplings have a thickness or depth of around 3 mm to 38 mm and around 3 mm to 38 mm of width or length jointed to the core (A4) of one tile slab (01). Further shows the surface finish (08) that can have different finishes such as honed, polished or similar. Further, also shows a protective coating consisting of a polyurethane transparent layer (3). Further also shows a resin sealant material (15) that is applied during the manufacturing process to protect the coupling joints (13). Further, also shows a micro bevelled edge (17) on all four sides of tile slab. Further in addition, it shows a backing layer (14) consisting of cork and a syntactic foam material that is acoustical and thermal and a comfortable underfoot feeling, according to the invention.

Figure 3:
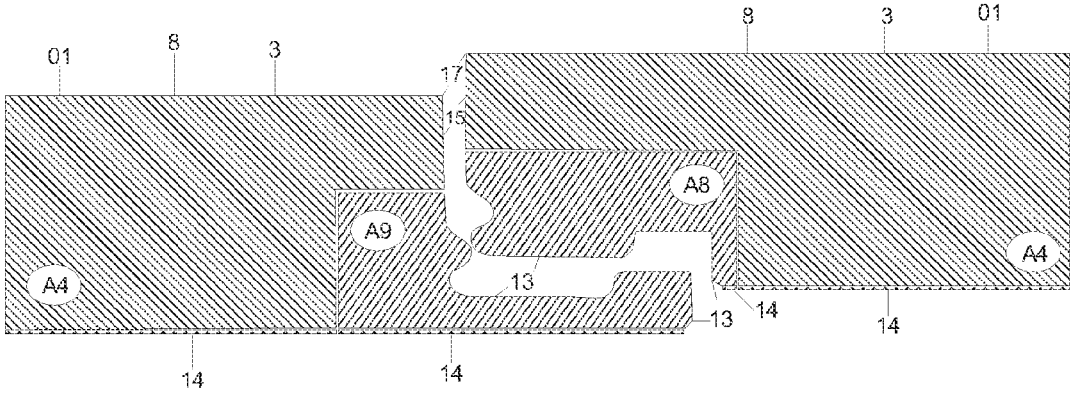
FIGS. 3 and 4 are diagrams showing sectional views of the embodiments of the natural stone tile slab (01) connecting together, according to the invention.

Referring to FIG. 3 represents a tile slab (01) consisting of a natural stone core (A4) with mechanical locking system couplings namely (A8-A9), generally the same features as shown in FIG. 2, but it illustrates the manner in which said couplings (A8-A9) connect together by mechanical locking means without the use of cement, adhesives and grout, according to the invention.

Figure 4:
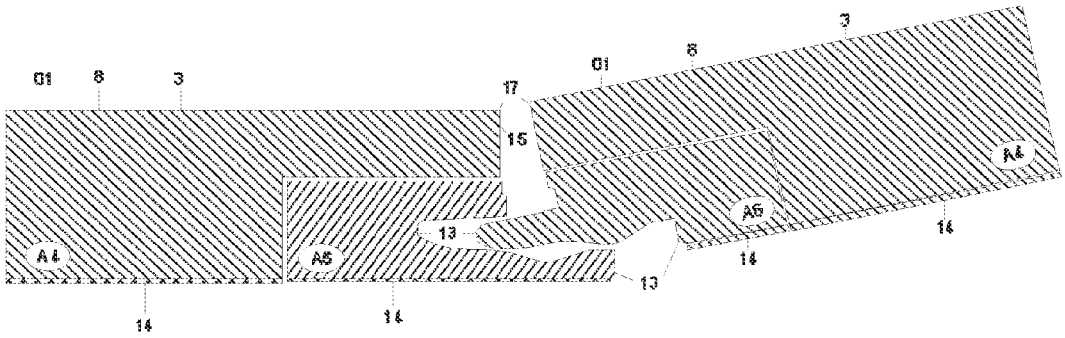

Referring to FIG. 4 represents a tile slab (01) consisting of a natural stone core (A4) with mechanical locking system couplings namely (A6-A5), generally the same features as shown in FIG. 1, but it illustrates the manner in which said couplings (A6-A5) connect together by mechanical locking means without the use of cement, adhesives and grout, according to the invention.

To better illustrate the characteristics according to the invention, as an example the following FIGS. (1-4) and the related information, describe in more detail the invention.

The invention claimed is:

1. A groutless tile system for use in creating tiled floor, wall or ceiling surfaces comprising a plurality of tiles composed of a material selected from the group consisting of cement based tiles, softwood, hardwood, fiberboard, engineered plywood, agglomerated cork, rubber, and composite tile materials, each tile being formed with (i) a top portion having a first surface area and a bottom portions having a second surface area, the top portion's first surface area being larger than the bottom portion's second surface area to form a substantially 90° overhang around the circumference of each tile and (ii) sides under the overhang which are substantially planar and lacking incurvature; and coupling means for coupling the tiles in the system to each other, the coupling means including a plurality of tongue and groove mating and interlocking polyvinyl chloride coupling members, each member having a height at least matching the sides of the tile under the overhang and a width at least matching the width of the overhang, the plurality of tiles and coupling means forming a substantially gapless floor, ceiling or wall surface when coupled.

2. The system according to claim 1 wherein the width and height of the coupling members is between 3 and 38 mm, and the width and height of the area under the tile overhang matches the width and height of the coupling members.

3. The system according to claim 2 additionally comprising a backing layer covering the underside of the coupled floor, ceiling or wall tile system.

4. The system according to claim 3 wherein the backing layer is selected from cork and syntactic foam.

5. The system according to claim 1 wherein the tiled surface is a ceiling or a wall.

6. The system according to claim 5 wherein the group of tiles additionally consists of natural stone and porcelain.

7. The system according to claim 1 wherein the tiled surface is a floor.

8. A groutless tile system for use in creating tiled floor, wall or ceiling surfaces comprising a plurality of tiles composed of a material selected from the group consisting of cement based tiles, softwood, hardwood, fiberboard, engineered plywood, agglomerated cork, rubber, and composite tile materials, each tile being formed with (i) a top portion having a first surface area and a bottom portions having a second surface area, the top portion's first surface area being larger than the bottom portion's second surface area to form a substantially 90° overhang around the circumference of each tile and (ii) sides under the overhang which are substantially planar and lacking incurvature;

coupling means for coupling the tiles in the system to each other, the coupling means including a plurality of tongue and groove mating and interlocking polyvinyl chloride coupling members, each member having a height at least matching the sides of the tile under the overhang and a width at least matching the width of the overhang;

a backing layer covering the underside of the coupled plurality of tiles.

9. The system according to claim 8 wherein the width and height of the coupling members is between 3 and 38 mm, and the width and height of the area under the tile overhang matches or is less than the width and height of the coupling members.

10. The system according to claim 9 wherein the backing layer is selected from cork and syntactic foam.

11. The system according to claim 9 wherein the tiled surface is a ceiling or a wall.

12. The system according to claim 11 wherein the group of tiles additionally consists of natural stone and porcelain.

13. The system according to claim 9 wherein the tiled surface is a floor.

14. A groutless tile system for use in creating tiled floor, wall or ceiling surfaces comprising a plurality of tiles composed of a material selected from the group consisting of cement based tiles, softwood, hardwood, fiberboard, engineered plywood, agglomerated cork, rubber, and composite tile materials, each tile being formed with (i) a top portion having a first surface area and a bottom portions having a second surface area, the top portion's first surface area being larger than the bottom portion's second surface area to form a substantially 90° overhang around the circumference of each tile and (ii) sides under the overhang which are substantially planar and lacking incurvature; and coupling means for coupling the tiles in the system to each other, the coupling means including a plurality of tongue and groove mating and interlocking polyvinyl chloride coupling members, each coupling member having a width and height of between 3 and 38 mm and a height of the area under the tile overhang matching the width and height of the coupling member, the plurality of tiles and coupling means forming a substantially gapless surface when coupled.

15. The system according to claim 14 additionally comprising a backing layer selected from cork and syntactic foam covering the underside of the coupled plurality of tiles.

16. The system according to claim 14 wherein the tiled surface is a ceiling or a wall.

17. The system according to claim 16 wherein the group of tiles additionally consists of natural stone and porcelain.

18. The system according to claim 14 wherein the tiled surface is a floor.

* * * * *